US007967920B2

(12) United States Patent
Kula et al.

(10) Patent No.: US 7,967,920 B2
(45) Date of Patent: Jun. 28, 2011

(54) METHOD AND MEASUREMENT SYSTEM FOR THE CONTROL OF AN ACTIVE CHARGE SURFACE IN THE LOW PRESSURE CARBURIZING PROCESS

(75) Inventors: Piotr Kula, Lódz (PL); Józef Olejnik, Swiebodzin (PL)

(73) Assignees: Seco/Warwick S.A., Swiebodzin (PL); Politechnika Lodzka, Lodz (PL)

( * ) Notice: Subject to any disclaimer, the term of this patent is extended or adjusted under 35 U.S.C. 154(b) by 424 days.

(21) Appl. No.: 12/078,442

(22) Filed: Mar. 31, 2008

(65) Prior Publication Data

US 2008/0277029 A1 Nov. 13, 2008

(30) Foreign Application Priority Data

Apr. 2, 2007 (PL) ..... 382118

(51) Int. Cl.
*C21D 1/773* (2006.01)
*C23C 8/20* (2006.01)

(52) U.S. Cl. ..... 148/206; 266/250; 266/251; 266/252; 266/79; 266/83; 266/90; 266/144; 148/215; 148/223

(58) Field of Classification Search ..... 266/79, 266/144, 250, 251, 252, 83, 90; 148/206, 148/215, 223
See application file for complete search history.

(56) References Cited

U.S. PATENT DOCUMENTS 4,410,758 A * 10/1983 Grolitzer ..... 136/254
6,846,366 B2 1/2005 Kawata et al.
2006/0102254 A1 5/2006 Kula et al.

FOREIGN PATENT DOCUMENTS

DE 103 59 554 A1 7/2005
JP A-2002-173759 6/2002
PL 356754 5/2004

* cited by examiner

*Primary Examiner* — Roy King
*Assistant Examiner* — Lois Zheng
(74) *Attorney, Agent, or Firm* — Oliff & Berridge, PLC

(57) ABSTRACT

A method and measurement system for the control of an active charge surface in a low pressure carburizing process can avoid formation of by-products and achieve regular carburized layers. This can be achieved through sampling of outlet gas at a specified time and comparison with experimentally set model characteristics.

6 Claims, 2 Drawing Sheets

METHOD AND MEASUREMENT SYSTEM FOR THE CONTROL OF AN ACTIVE CHARGE SURFACE IN THE LOW PRESSURE CARBURIZING PROCESS

BACKGROUND

The present invention is directed to a method and measurement system for the control of an active charge surface in the under-pressure gas carburizing process, advantageously in the atmosphere of a ternary carburizing mixture, one which includes ethylene, acetylene and hydrogen.

From Japanese Patent Publication No. JP 2002173759 a control system of a gaseous atmosphere and a device which co-works with it for vacuum carburizing is known. In this system the carbon potential (PC) of the atmosphere created on the base of hydrocarbons is measured and regulated by a calculation system on the basis of signals from the pressure process sensors and the partial pressure of a hydrogen sensor in the process chamber or outlet pipes.

From German Patent Publication No. DE 10359554 one knows the set for the details carburizing in the vacuum furnace, a set which is able to suit the carbon supply to the actual details' demands. In the set, in the working furnace chamber or on the outlet pipes in front of the vacuum pump, the sensors have been installed, the sensors of hydrogen concentration and/or acetylene and/or combined carbon content, e.g. mass spectrometer, sensors of which signals, after the processing in the calculating system, is transferred an impulse to the metering valve of the demanded proportioning size of e.g. acetylene, appropriately to the temporary demand of the charge depended on the actual carbon content in steel.

Another solution was presented in U.S. Pat. No. 6,846,366, where one finds the description of a device and carburizing method with pressure from 13 to 1000 Pa, in an atmosphere containing less than 20% capacity of carbon monoxide, of whose content is controlled by the heat conduction measurement with a Pirani vacuum meter in order to regulate the temperature, pressure and gaseous atmosphere process parameters.

From Polish Patent Publ. No. P-356754 one knows the ternary mixture containing ethylene, acetylene and hydrogen or ammonia, a mixture which during the carburizing process in the underpressure proves the synergetic effect of a high degree of hydrocarbons on the charge surface. This results in skilful carbon transmission from the mixture to the charge surface without the creation of burdensome by-products in the form of tar or/and soot. In the process the carbon transfer from the atmosphere to the charge area takes place by the indirect phase, which is created on the whole charge area—hydrogenated carbon deposit (Kula et al 2006). Carbon transmission to the surface occurs to be highly intensive, and on these grounds the technological process is divided into short, several minutes' carbon boost phase, and the phase of entirely diffusive carbon distribution into steel. These are the non-stationary and non-equilibrium process conditions, of which the effect course and diffusive layer growing may be programmed entirely on the basis of a computer simulation through the expert system, including the data base on treated materials and physical and mathematical process model. In the conditions of a changeable productive line the expert system programs the process course in a correct way provided that one introduces in it the required layer parameters, process temperature, steel grade and active charge surface, one which is difficult to estimate in the production conditions which may result in some error.

SUMMARY

The nature of the method, according to the invention, is based on the fact that signals from a mass flow transducer, ones which are collected in the time interval between the $30^{th}$ and $300^{th}$ second of the first phase of carbon boost, are transmitted to an expert system in order to compare them with experimentally fixed ones in the function of the active charge surface, with model characteristics for their indications, and to calculate the correction for the accepted ones in the system established charge surface.

When it comes down to the nature of the system, owing to the invention, it is based on a returnable by-pass circuit, connected to a technological pump set, or vacuum pump set, and a vacuum furnace, contains among others a converter of mass flow signal of an outlet gas sample and a calibration valve, which is connected with the use of a reference valve with a system which supplies reference gases, ones which are intended for the calibration system.

It seems to be beneficial when the by-pass circuit, contains in series connection a first cut-off valve, a gas filter, a second cut-off valve, a mass flow signal transducer, a calibration valve and a third cut-off valve. This by-pass circuit is switched off between the input and output of the vacuum pump set, while between the cut-off valve and gas filter the reference valve output is switched on.

At the same time it seems also to be beneficial for the by-pass circuit, to contain in series connection the first cut-off valve, gas filter, second cut-off valve, a supporting vacuum pump, a pressure stabilization reducer, the mass flow signal transducer, the calibration valve and the third cut-off valve. This by-pass circuit is switched on between the vacuum pump input and the output of the vacuum furnace technological cut-off valve, while the reference valve output is switched on between the output of supporting vacuum pump and the reducer.

The method and the system constituting a compact measurement system eliminate the risk of charge damage as well as/or installation damage resulting from the possibility of error and imprecise data on the area of the treated elements input by the operator.

BRIEF DESCRIPTION OF THE DRAWINGS

The invention will be described with reference to the following figures where.

DETAILED DESCRIPTION OF EMBODIMENTS

Figure 1:
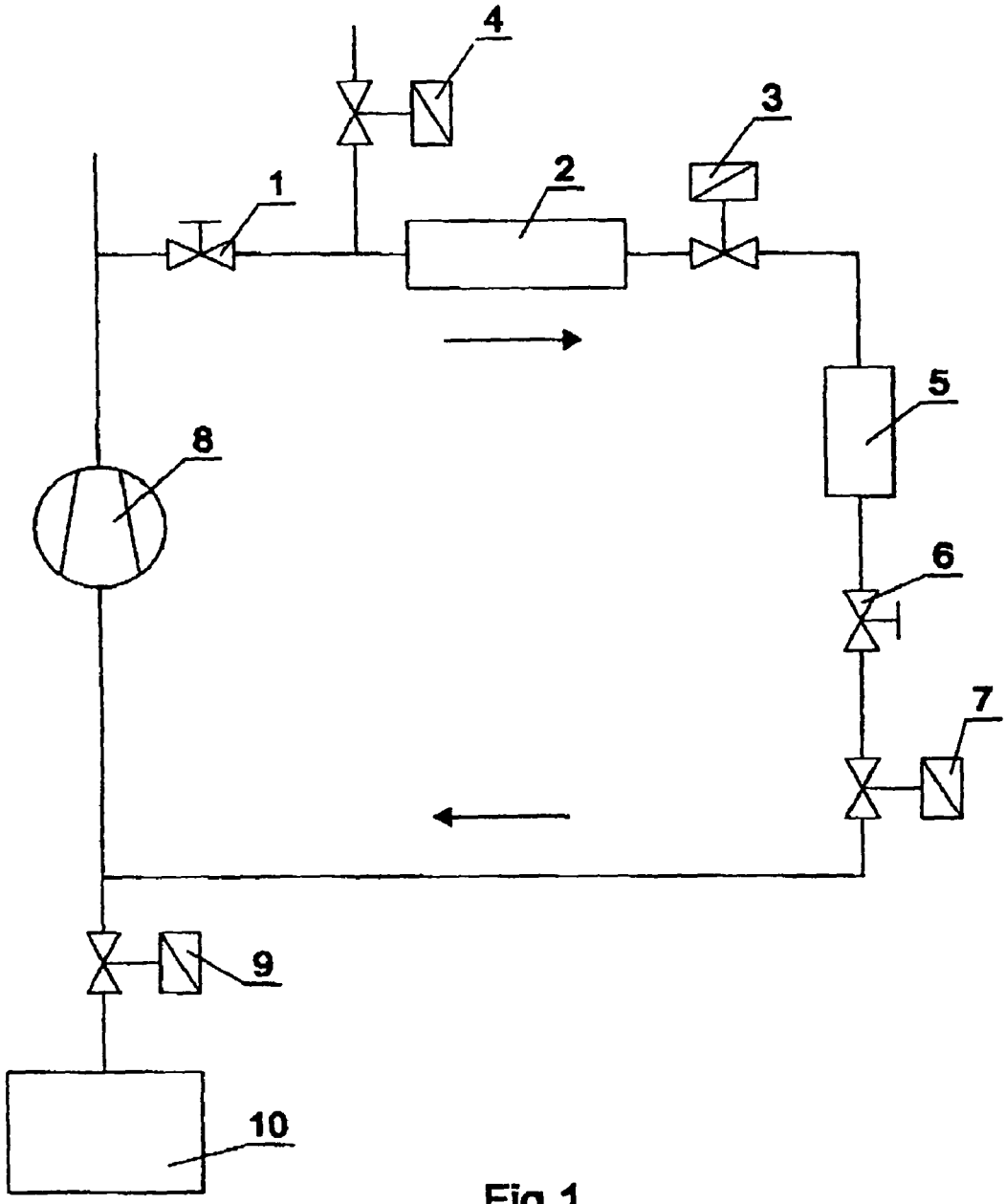
FIG. 1 is a measurement and control system with a mass flow signal transducer placed in a returnable by-pass circuit of a main vacuum pump.

The system in the first variant FIG. 1 presented is installed as a returnable by-pass circuit of a pump or vacuum pump set (8), of which input is connected, by means of a technological cut-off valve (9), to a vacuum furnace (10). What is more, the by-pass circuit branch is switched on between the input and output of vacuum pump set (8), one containing in series device connection: a first cut-off valve (1) a gas filter (2), a second cut-off valve (3), a mass flow signal transducer (5), a departure gas sample calibration valve (6) and a third cut-off valve (7), while a reference valve output is switched on between the cut-off valve (1) and gas filter (2), by a reference valve (4) supplying from outside reference gases set for system calibration.

The estimation of volume reference flow in the system is performed through the gas method with reference to the value of the fixed mass flow of the calibration gases, e.g. nitrogen, helium or the air, through the reference valve (4), mass flow signal converter (5), calibration valve (6) and cut-off valve (7).

Figure 2:
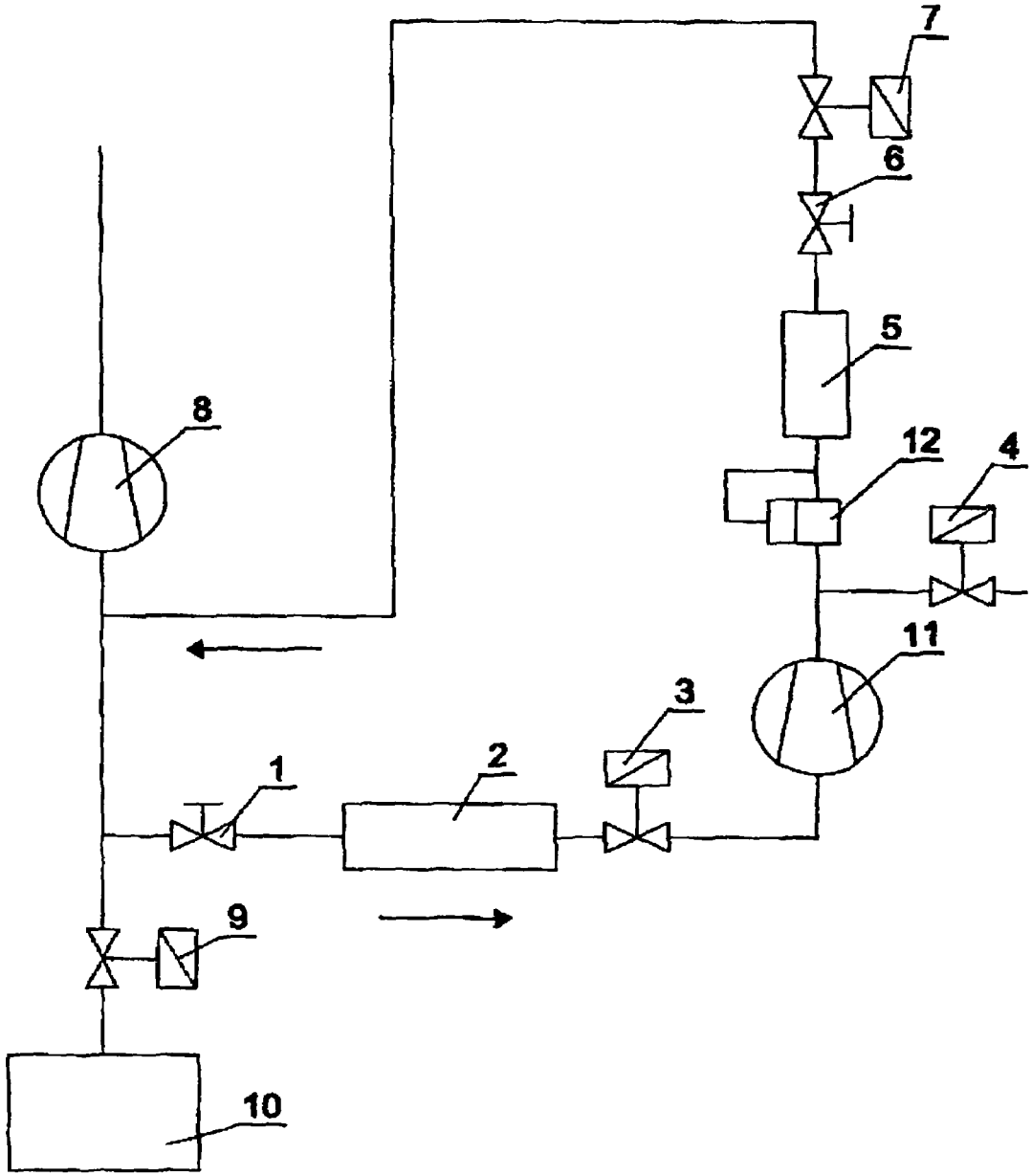
FIG. 2 is a variant of the system with the mass flow signal transducer placed in the returnable by-pass circuit of the main pump system on a vacuum side.

In the FIG. 2 variant, the by-pass circuit contains in series connection: the first cut-off valve (1), gas filter (2), the second cut-off valve (3), a supporting vacuum pump (11), a pressure stabilization reducer (12), mass flow signal transducer (5), calibration valve (6) and third cut-off valve (7). The by-pass circuit is switched on between the vacuum pump set (8) input and technological cut-off valve (9) and output, vacuum furnace (10), while the reference valve output from reference valve (4) is switched on between the supporting vacuum pump (11) output and the reducer (12).

A carburizing process is carried out in a ternary carburizing mixture, one which includes ethylene, acetylene and hydrogen, in the pressure range from 0.1 to 10 kPa and the temperature range from 800 to 1100° C. A way through the side measure shunt becomes open in the time interval from the 30th to 300th second of the continuing first phase of carburizing, whereas electrical signals collected in the period are transmitted to an expert system in order to compare with the model characteristics experimentally set in the function of an active charge area, and to make calculations of the correction for the accepted estimated charge area, one accepted in the system. As a result of the correction in the course of the process, one achieves regular carburized layers of a correct shape, layers of carbon concentration complex profile, and avoids the creation of by-products, such as tar and soot.

Example No. 1

In the universal vacuum furnace (10) chamber, of a working chamber size 400×400×600 mm, one placed some elements made of steel 16CrMn5, of which the surface was estimated to be 2.1 $m^2$, and subsequently the obtained rated value was introduced to the simulation and steering furnace system together with the left layer's parameters, that is: superficial carbon concentration −0.75% of weight, contractual depth of carburized layer 0.6 mm with the limiting concentration 0.4% of the C weight, and the process parameters—950° C. temperature and carboniferous gas proportioning pressure in the boost phases with pressure fluctuation from 0.5 to 0.8 kPa. The simulation system programmed the carburizing process organization according to the following phase sequence:

convection heating in nitrogen to the temperature 700° C.,
vacuum heating to the temperature 950° C.,
carbon boost—5 min 41 s,
diffusion—11 min 22 s,
carbon boost—3 min 24 s,
diffusion 18 min 53 s,
carbon boost—3 min 24 s,
diffusion 37 min,
carbon boost—3 min 24 s,
diffusion—23 min 33 s,
cooling to the hardening temperature 840° C. with 5° C./min speed, and
hardening in nitrogen in the 10 bar pressure.

For this, the optimal proportioning values of the carburizing mixture of the content were chosen: ethylene (26%), acetylene (26%) and hydrogen (46%). After 30 s from the first phase of carbon boost start, the system opened the returnable shunting circuit of the vacuum pump (8), initiating the outlet gas sample flow through the mass flow signal transducer (5) and subsequently closed the circuit after the next 270 s. On the basis of received signals, the system set the average outlet gas depth 0.156 g/$dm^3$, and while comparing the model characteristics corrected the active charge area up to 2.6 $m^2$. In the next carbon boost phases the system accepted the corrected values of the carburizing mixture proportioning. As a result of the process, one achieves regular carburized layers of a correct shape of the complex carbon concentration profile (CR 0.75% C, AHT 0.59 mm), and avoids the creation of by-products, such as tar and soot.

Example No. 2

In the universal vacuum furnace (10) chamber, of a working chamber size 400×400×600 mm, one placed some elements made of steel 16CrMn5, of which the area was estimated to be 2.3 $m^2$, and subsequently the value was introduced to the simulation and steering furnace system together with the left layer's parameters: area carbon concentration −0.75% of weight, contractual depth of carburized layer 0.65 mm with the limiting concentration 0.4% of the C weight, and the process parameters −1000° C. temperature, and a carbonitriding gas proportioning pressure in the boost phases with pressure fluctuation from 0.5 to 0.8 kPa. In order to limit the increase of austenite seeds one chose the option of prenitriding. The simulation system programmed the carburizing process organization according to the following phase sequence:

convection heating in nitrogen to the temperature 400° C.,
heating from the temperature 400° C. to 700° C. in the pressure 0.25 kPa during ammonia proportioning to the chamber
vacuum heating to the temperature 1000° C.,
carbon boost—6 min 12 s
diffusion—29 min 33 s
carbon boost—4 min 47 s
diffusion—17 min 07 s
hardening in nitrogen in the 10 bar pressure.

From this, the optimal proportioning values of the carburizing mixture of the content were chosen: ethylene (26%), acetylene (26%) and hydrogen (46%). After 60 s from the first phase of carbon boost start, the system opened the returnable shunting circuit of the vacuum pump (8) initiating the departure gas sample flow through the mass flow signal converter (5), and subsequently closed the circuit after the next 180 s. On the basis of the received signals, the system set the average departure gas depth 0.125 g/$dm^3$, and while comparing this with the model characteristics decided that the mentioned value can be tolerated. The system thus accepted the set charge area to carry out the second phase of carbon boost. As a result of the process one achieves regular carburized layers of a correct shape of the complex carbon concentration profile (CR 0.74% C, AHT 0.66 mm), and also, in the given example, one avoided the creation of by-products, such as tar and soot.

The invention claimed is:

1. A measurement system for control of an active charge surface in a low pressure carburizing process, in a pressure range from 0.1 to 10 kPa, and in a temperature range from 800 to 1100° C., comprising a returnable by-pass circuit connected to at least one vacuum pump and a vacuum furnace, the returnable by-pass circuit containing, in series connection, at least a first cut-off valve, a gas filter, a second cut-off valve, a mass flow signal transducer of an outlet gas sample, a calibration valve and a third cut-off valve, connected by a reference valve of a system that supplies reference gases meant for system calibration.

2. The measurement system according to claim 1, wherein the by-pass circuit is switched on between an output and an input of the vacuum pump, while output from the reference valve is switched on between the first cut-off valve and the gas filter.

3. The measurement system, according to claim 1, wherein the by-pass circuit further comprises a supporting vacuum pump and a pressure stabilisation reducer that are switched on between the first cut-off valve and the mass flow signal transducer, and the by-pass circuit is switched on between an input of the vacuum pump and an output of a technological cut-off valve of the vacuum furnace, while output of the reference valve is switched on between the output of the supporting vacuum pump and the reducer.

4. A method of controlling an active charge surface in a low pressure carburizing process with the measurement system according to claim 1, the method comprising:

putting the outlet gas through the by-pass circuit in a time interval between a $30^{th}$ and $300^{th}$ second of a continuing first phase of a carbon boost;

collecting signals reflecting a mass flow of the outlet gas sample in the time interval;

transmitting the collected signals reflecting the mass flow to an expert system;

comparing the signals with model characteristics experimentally set as a function of the active charge surface area for indicators by the expert system; and estimating a correction for an accepted estimated charge surface.

5. A method of controlling an active charge surface in a low pressure carburizing process with the measurement system according to claim 2, the method comprising:

putting the outlet gas through the by-pass circuit in a time interval between a $30^{th}$ and $300^{th}$ second of a continuing first phase of a carbon boost;

collecting signals reflecting a the mass flow of the outlet gas sample in the time interval;

transmitting the collected signals reflecting mass flow to an expert system;

comparing the signals with model characteristics experimentally set as a function of the active charge surface area for indicators by the expert system; and estimating a correction for an accepted estimated charge surface.

6. A method of controlling an active charge surface in a low pressure carburizing process with the measurement system according to claim 3, the method comprising:

putting the outlet gas through the by-pass circuit in a time interval between a $30^{th}$ and $300^{th}$ second of a continuing first phase of a carbon boost;

collecting signals reflecting a the mass flow of the outlet gas sample in the time interval;

transmitting the collected signals reflecting mass flow to an expert system;

comparing the signals with model characteristics experimentally set as a function of the active charge surface area for indicators by the expert system; and estimating a correction for an accepted estimated charge surface.

* * * * *